US010716343B2

(12) United States Patent
Noll

(10) Patent No.: US 10,716,343 B2
(45) Date of Patent: Jul. 21, 2020

(54) STOWABLE APPAREL ITEM

(71) Applicant: NIKE, Inc., Beaverton, OR (US)

(72) Inventor: Eric R. Noll, Portland, OR (US)

( * ) Notice: Subject to any disclaimer, the term of this patent is extended or adjusted under 35 U.S.C. 154(b) by 160 days.

(21) Appl. No.: 15/678,667

(22) Filed: Aug. 16, 2017

(65) Prior Publication Data

US 2018/0049489 A1 Feb. 22, 2018

Related U.S. Application Data

(60) Provisional application No. 62/377,086, filed on Aug. 19, 2016.

(51) Int. Cl.

| | |
|---|---|
| ***A41D 15/00*** | (2006.01) |
| ***A41D 3/02*** | (2006.01) |
| ***A41D 15/04*** | (2006.01) |
| ***A41D 27/20*** | (2006.01) |
| ***A41D 3/00*** | (2006.01) |

(Continued)

(52) U.S. Cl.

CPC ..... *A41D 15/00* (2013.01); *A41D 1/06* (2013.01); *A41D 3/00* (2013.01); *A41D 3/02* (2013.01); *A41D 15/04* (2013.01); *A41D 27/20* (2013.01); *A42B 1/048* (2013.01); *A41D 2200/20* (2013.01); *A41D 2400/422* (2013.01)

(58) Field of Classification Search

CPC ..... A41D 2400/422; A41D 2200/20; A41D 27/20; A41D 15/00; A41D 15/04; A41D 1/02; A41D 3/02; A41D 1/04; A41D 3/00; A41D 1/06; A41D 3/04; A41D 3/08; A42B 1/048; A45F 2003/002; A45F 2003/003; A45F 3/005; A45F 2003/007; A45F 3/02; A45F 4/02

See application file for complete search history.

(56) References Cited

U.S. PATENT DOCUMENTS 1,702,143 A * 2/1929 Weisz ..... A41D 3/04 2/84
2,058,474 A * 10/1936 Long ..... A41D 15/04 2/85

(Continued)

FOREIGN PATENT DOCUMENTS

CN 202286422 U 7/2012
CN 203633548 U 6/2014

(Continued)

OTHER PUBLICATIONS

International Search Report and Written Opinion dated Nov. 24, 2017 in International Patent Application No. PCT/US2017/047486, 14 pages.

(Continued)

*Primary Examiner* — Amy Vanatta

(74) *Attorney, Agent, or Firm* — Shook Hardy & Bacon, LLP

(57) ABSTRACT

An apparel item for an upper torso of a wearer having a pocket structure affixed to an inner-facing surface of apparel item. The pocket structure is sized to be able to receive and store the apparel item when the apparel item is not being worn by a wearer, in what is referred to as a 'stowed' configuration. The apparel item may be formed from a lightweight material, such that when the apparel item is in the 'stowed' configuration, the apparel item may be easily carried in the hand of a wearer.

17 Claims, 6 Drawing Sheets

(51) Int. Cl.
*A41D 1/06* (2006.01)
*A42B 1/04* (2006.01)

(56) References Cited

U.S. PATENT DOCUMENTS

| | | | | | |
|---|---|---|---|---|---|
| 2,143,931 | A * | 1/1939 | Aronson | A41D 3/00 | 2/93 |
| 2,292,347 | A | 8/1942 | Perkins | | |
| 2,971,198 | A * | 2/1961 | Tomich | A41D 3/08 | 2/84 |
| 3,670,340 | A | 6/1972 | Walker | | |
| 4,078,264 | A * | 3/1978 | DeGennaro | A41D 3/08 | 2/88 |
| 4,141,082 | A | 2/1979 | Makazawa et al. | | |
| 4,227,264 | A * | 10/1980 | Spector | A41D 15/00 | 2/272 |
| 4,351,066 | A | 9/1982 | Pearsall | | |
| 4,404,687 | A * | 9/1983 | Hager | A41D 3/005 | 2/94 |
| 4,404,689 | A * | 9/1983 | DeWan | A41D 27/20 | 2/247 |
| D277,048 | S | 1/1985 | Peyser | | |
| 4,502,155 | A * | 3/1985 | Itoi | A41D 3/00 | 2/115 |
| 4,523,703 | A | 6/1985 | McKenna | | |
| 4,700,409 | A * | 10/1987 | De Lott | A45F 4/12 | 2/102 |
| 4,944,042 | A | 7/1990 | Dewan | | |
| 5,010,592 | A * | 4/1991 | Skiles, Jr. | A41D 3/00 | 2/108 |
| 5,452,476 | A | 9/1995 | Jenks | | |
| 5,564,125 | A | 10/1996 | Waldman et al. | | |
| 5,787,504 | A | 8/1998 | Wu | | |
| 5,884,331 | A | 3/1999 | Barrajas | | |
| 5,901,375 | A * | 5/1999 | Davis | A41D 15/04 | 2/69 |
| D439,029 | S | 3/2001 | Goldman | | |
| 6,332,222 | B1 | 12/2001 | Graham | | |
| 6,370,692 | B1 * | 4/2002 | Duyn | A41D 3/02 | 2/86 |
| 6,385,775 | B1 | 5/2002 | Komjati | | |
| 6,564,388 | B1 | 5/2003 | Poston | | |
| 7,143,450 | B2 | 12/2006 | Green, III | | |
| 7,673,348 | B2 | 3/2010 | Williams | | |
| 8,032,948 | B2 * | 10/2011 | Anderson | A41D 3/00 | 2/69 |
| D688,849 | S | 9/2013 | Kochling | | |
| 8,998,045 | B2 | 4/2015 | Cartwright | | |
| 9,060,553 | B2 | 6/2015 | Crye | | |
| 9,125,477 | B2 | 9/2015 | Killion | | |
| D751,288 | S | 3/2016 | Majmundar | | |
| 2002/0088048 | A1 * | 7/2002 | Turner | A41D 3/00 | 2/93 |
| 2006/0218690 | A1 | 10/2006 | James | | |
| 2007/0083983 | A1 | 4/2007 | Barclay | | |
| 2009/0205096 | A1 | 8/2009 | Seemann | | |
| 2009/0241235 | A1 | 10/2009 | Weinreb | | |
| 2012/0060260 | A1 | 3/2012 | Kochling | | |
| 2013/0042383 | A1 * | 2/2013 | Ryan | A41D 15/00 | 2/84 |
| 2014/0373246 | A1 | 12/2014 | Chapuis | | |
| 2015/0101720 | A1 | 4/2015 | Lee | | |
| 2015/0150319 | A1 | 6/2015 | Walmsley | | |
| 2015/0250240 | A1 | 9/2015 | Hunkele | | |
| 2016/0066632 | A1 | 3/2016 | Puente et al. | | |
| 2016/0120241 | A1 | 5/2016 | Rose | | |
| 2016/0157535 | A1 | 6/2016 | Tirro et al. | | |
| 2016/0174633 | A1 | 6/2016 | Macrae | | |
| 2016/0183612 | A1 | 6/2016 | Romero et al. | | |
| 2017/0224033 | A1 * | 8/2017 | Latta, Jr. | A41D 15/04 | |

FOREIGN PATENT DOCUMENTS

| | | | | |
|---|---|---|---|---|
| CN | 204378000 | U | 6/2015 | |
| DE | 29514626 | U1 | 11/1995 | |
| GB | 434133 | A * | 8/1935 | A41D 3/08 |
| JP | H09111513 | A | 4/1997 | |
| WO | 2015153257 | A1 | 10/2015 | |
| WO | 2015200193 | A1 | 12/2015 | |
| WO | 2016019234 | A1 | 2/2016 | |
| WO | 2016106317 | A1 | 6/2016 | |

OTHER PUBLICATIONS

International Preliminary Report on Patentability dated Feb. 28, 2019 in International Patent Application No. PCT/US2017047486, 7 pages.

* cited by examiner

STOWABLE APPAREL ITEM

CROSS-REFERENCE TO RELATED APPLICATIONS

This application, having Ser. No. 15/678,667 NIKE.279946/160323US02 and entitled "Stowable Apparel Item," claims priority to U.S. Provisional Application No. 62/377,086, and entitled "Stowable Apparel Item," which was filed on Aug. 19, 2016. The entirety of the aforementioned application is incorporated by reference herein.

FIELD OF THE INVENTION

The present invention relates to an apparel item which can be collapsed and stored within a pocket structure located on the apparel item.

BACKGROUND

For many outdoor activities the weather plays a key role in determining a person's enjoyment of the activity. If the chance of inclement weather during the outdoor activity exists, the person must decide whether or not to take along an apparel item for protection from the elements. However, carrying the apparel item when not being worn can become a burdensome task.

BRIEF DESCRIPTION OF THE DRAWINGS

Examples of the present invention are described in detail below with reference to the attached drawing figures, wherein.

DETAILED DESCRIPTION

Figure 1A:
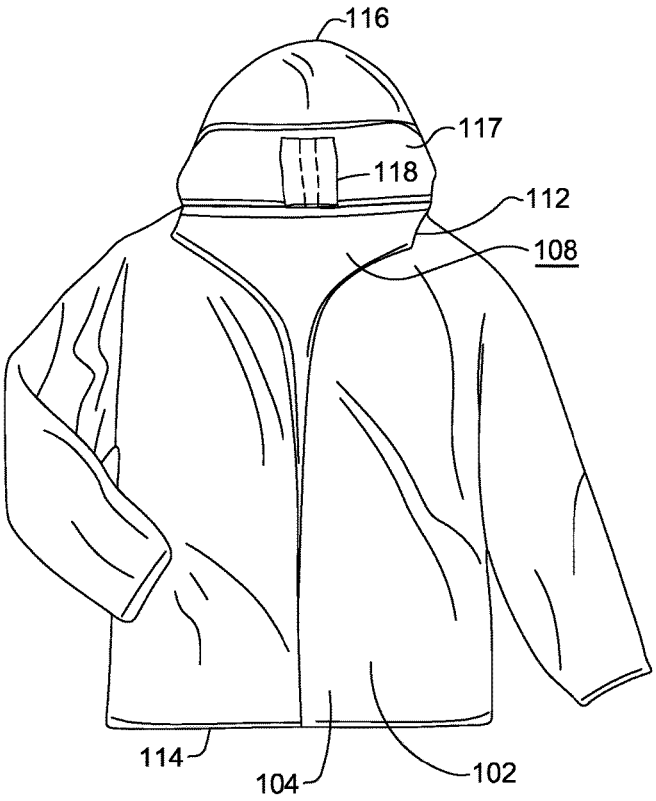
FIG. 1A illustrates a front view of an exemplary apparel item having a pocket structure positioned adjacent to a hood portion of the exemplary apparel item, in accordance with an aspect herein.

The subject matter of the present invention is described with specificity herein to meet statutory requirements. However, the description itself is not intended to limit the scope of this disclosure. Rather, the inventors have contemplated that the disclosed and claimed subject matter might also be embodied in other ways, to include different steps or combinations of steps similar to the ones described in this document, in conjunction with other present or future technologies. Moreover, although the terms "step" and/or "block" might be used herein to connote different elements of methods employed, the terms should not be interpreted as implying any particular order among or between various steps herein disclosed unless and except when the order of individual steps is explicitly stated.

At a high level, aspects herein are directed to an apparel item having a pocket structure, where the pocket structure is useable for stowing the apparel item when the apparel item is not in use. The pocket structure is positioned on the apparel item such that it remains relatively stationary when the wearer of the apparel item engages in athletic activities. For instance, when the apparel item is in the form of a jacket, the pocket structure may be located adjacent to the neckline area of the jacket as this area typically undergoes little movement during activities such as running as compared to, for instance, the sleeve portions of the jacket. When the apparel item is in the form of a pant, the pocket structure may be located adjacent to a rear waistband area of the pant as this area typically undergoes little movement during activities such as running as compared to, for example, the leg portions of the pant. By positioning the pocket structure in locations as described, the pocket structure is less likely to cause chaffing during movement which helps to reduce wearer distractions. Another advantage of this location of the pocket structure is that, when a wearer is also wearing a backpack, the pocket structure may be positioned above a backpack when the hood is in an upright position, such that the pocket structure and the backpack do not rub against one another.

In exemplary aspects, the pocket structure is sized and configured such that when the apparel item is stowed within the pocket structure, the wearer is able to easily grasp the resulting structure. For example, when the apparel item is in the form of a jacket, the pocket structure may comprise a strap that extends the length of the pocket structure. Moreover, the pocket structure is sized such that when the jacket is stowed, the resulting structure can fit into the palm of the wearer's hand. The strap can then be positioned around the wearer's fingers or palm to further facilitate carrying the stowed jacket even during athletic activities such as running. When the apparel item is in the form of a pant, the pocket structure is sized such that when the pant is stowed within the pocket structure, the stowed pant can be placed within a pack without taking up much space.

To further facilitate the storage of the apparel item, the apparel item may be formed of a lightweight or ultra-lightweight material such that the apparel item can be compressed into a small volume. Storage may also be enhanced by forming the pocket structure of, for example, a two-way or four-way stretch woven material. Due to the generally tight weave structure of woven textiles, the use of a woven material in the pocket structure helps to constrain the size of the pocket structure after the apparel item has been stowed. However, the use of the two-way or four-way stretch material enables the pocket structure to expand or contract to some degree to accommodate different sizes of apparel items.

Aspects herein are generally directed to an apparel item for an upper torso of a wearer having a torso portion adapted to cover a torso area of a wearer when the apparel item is in an as-worn configuration. The torso portion may have a front aspect, a back aspect, an inner-facing surface, and an outer-facing surface, wherein the torso portion defines at least a neck opening and a waist opening. The apparel item may further comprise a hood portion affixed to the torso portion at the neck opening of the torso portion, the hood portion having an inner-facing surface and an outer-facing surface. Further, the apparel item may comprise a pocket structure affixed in part to the inner-facing surface of the torso portion proximate the neck opening such that the pocket structure is positioned adjacent to at least a part of the hood portion, wherein the pocket structure is sized to be able to receive and store the apparel item when the apparel item is in a stowed configuration.

In another aspect, an apparel item is provided comprising a torso portion adapted to cover a torso area of a wearer when the apparel item is in an as-worn configuration, wherein the torso portion has at least a front aspect, a back aspect, an inner-facing surface, and an outer-facing surface, the torso portion defining at least a neck opening and a waist opening. The apparel item may further comprise a pocket structure affixed in part to the inner-facing surface of the torso portion proximate the neck opening wherein the pocket structure is sized to be able to receive and store the apparel item when the apparel item is in a stowed configuration. The pocket structure may include a first end, a second end, a first longitudinal edge, a second longitudinal edge, a first surface facing away from the inner-facing surface of the torso portion and an opposing second surface facing toward the inner-facing surface of the torso portion, the first surface and the second surface defining a void between the first surface and the second surface, wherein the first end of the pocket structure is closed, and wherein the second end of the pocket structure is open.

In yet another aspect, an apparel item is provided comprising a lower-body portion adapted to cover a lower-body of a wearer when the apparel item is in an as-worn configuration, the lower-body portion having at least a front aspect, a back aspect, a lateral aspect, a medial aspect, an inner-facing surface, and an outer-facing surface, the lower-body portion defining at least a torso opening, a first leg opening, and a second leg opening. The apparel item may further comprise a pocket structure affixed in part to the inner-facing surface of the lower-body portion, wherein the pocket structure is sized to be able to receive and store the apparel item when the apparel item is in a stowed configuration, the pocket structure including a open end, a closed end, a first longitudinal edge, a second longitudinal edge, a first surface facing away from the inner-facing surface of the lower-body portion and an opposing second surface facing toward the inner-facing surface of the lower-body portion, the first surface and the second surface defining a void between the first surface and the second surface, and wherein the open end of the pocket is positioned a first distance away from the torso opening of the apparel item, and wherein the first longitudinal edge of the pocket is positioned a second distance away from a lateral aspect of the apparel item.

Figure 1B:
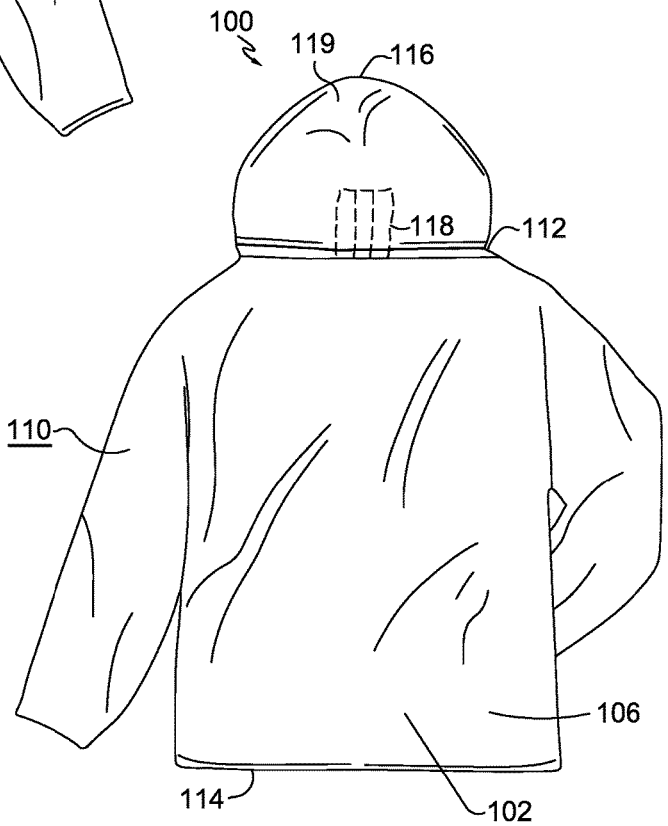
FIG. 1B illustrates a back view of the exemplary apparel item of FIG. 1A, in accordance with an aspect herein.

Referring now to FIGS. 1A and 1B, front and back views respectively of an apparel item 100 having a pocket structure 118 are depicted. While aspects discussed herein generally refer to a lightweight or an ultra-lightweight jacket formed of, for instance, a woven polyester or nylon material, it will be understood that aspects are not limited to any particular apparel item and/or any particular material. As used throughout this disclosure, the term "ultra-lightweight" refers to materials weighing between 10 to 150 grams per square meter. It is contemplated herein that the material forming the apparel item 100 may be treated with, for example, a durable water repellant (DWR) such that the apparel item 100 is substantially impervious to water. However, it is envisioned that the technology described herein may also be applied to other apparel items or materials which fall outside of the ultra-lightweight range discussed herein. For example, other fabrics, such as cotton, wool, silk, and the like and other methods of constructing the fabrics such as knitting are considered within the scope of this disclosure. Further, aspects herein may be applied to any apparel item having a hood, such as a hooded shirt or "hoodie", or any other type of apparel item that does not have a hood, such as a non-hooded shirt or vest. Accordingly, the depictions in the drawings are for exemplary purposes only and are in no way meant to limit the scope of the present disclosure.

As shown in FIGS. 1A and 1B, the apparel item 100 may have a torso portion 102 having a front aspect 104, a back aspect 106, an inner-facing surface 108 and an outer-facing surface 110. In accordance with aspects herein, the torso portion 102 may define at least a neck opening 112 and a waist opening 114. The torso portion 102 may also define other openings, such as arm holes or various types of ventilation apertures. Additionally, a hood portion 116 having an inner-facing surface 117 and an outer-facing surface 119 may be affixed to the torso portion 102 at the neck opening 112 of the torso portion 102. As described herein, the phrase "affixed to" is not meant to limit the scope of this disclosure. Rather, the term "affixed to" implies that a component may be directly affixed to another component, or that a component may be affixed at a location near another component. For example, as described herein, the hood portion 116 may be "affixed to" the torso portion 102. Therefore, the hood portion 116 may be affixed directly to the neck opening 112, or the hood portion may be affixed at a location near the neck opening 112. For example, the hood portion 116 may be affixed to the torso portion 102 at a location up to 15 centimeters below the neck opening 112. Moreover, unless indicated otherwise, the term "affixed to" may mean releasably affixing using, for instance, buttons, snaps, hook-and-loop fasteners, and the like, or permanently affixing using, for example, stitching, bonding, adhesives, and the like.

The apparel item 100 is depicted in FIGS. 1A and 1B as having a pocket structure 118 affixed to, at least in part, the inner-facing surface 108 of the apparel item 100, such that the pocket structure 118 is positioned adjacent to at least the inner-facing surface 117 of the hood portion 116. While other locations of the pocket structure 118 are considered within the scope of this disclosure, positioning the pocket structure 118 to be adjacent to at least a part of the hood portion 116 is advantageous to reduce chafing against the skin of a wearer. For example, when a wearer dons the apparel item, the hood portion 116 may either be worn on the head of the wearer, or the hood portion 116 may "hang" down against the back of a wearer. When the hood portion 116 is "hanging" down against the back of a wearer, no portion of the pocket structure 118 will be in contact with the skin of a wearer, thus reducing chafing. However, when the hood portion 116 is worn on the head of the wearer, the pocket structure 118 is positioned such that the curvature of the wearer's spine generally prevents the pocket structure 118 from rubbing against the skin on the back of a wearer's neck.

In accordance with aspects herein, the pocket structure 118 is sized to be able to receive and store the apparel item 100 when the apparel item 100 is in a "stowed" configuration. The "stowed" configuration, as described herein, generally refers to a configuration in which the apparel item 100 is contained within the pocket structure 118. Conversely, a "wearable" configuration refers to a configuration in which the apparel item 100 is not contained within the pocket structure 118, such that the apparel item 100 may be donned or doffed easily by a wearer. The steps of converting the apparel item 100 from a "wearable" configuration to the "stowed" configuration can be seen, and are described with respect to FIGS. 5A-5C, with FIG. 5D depicting a apparel item, such as the apparel item 100, in the "stowed" configuration. These figures will be discussed in greater length below.

Figure 4:
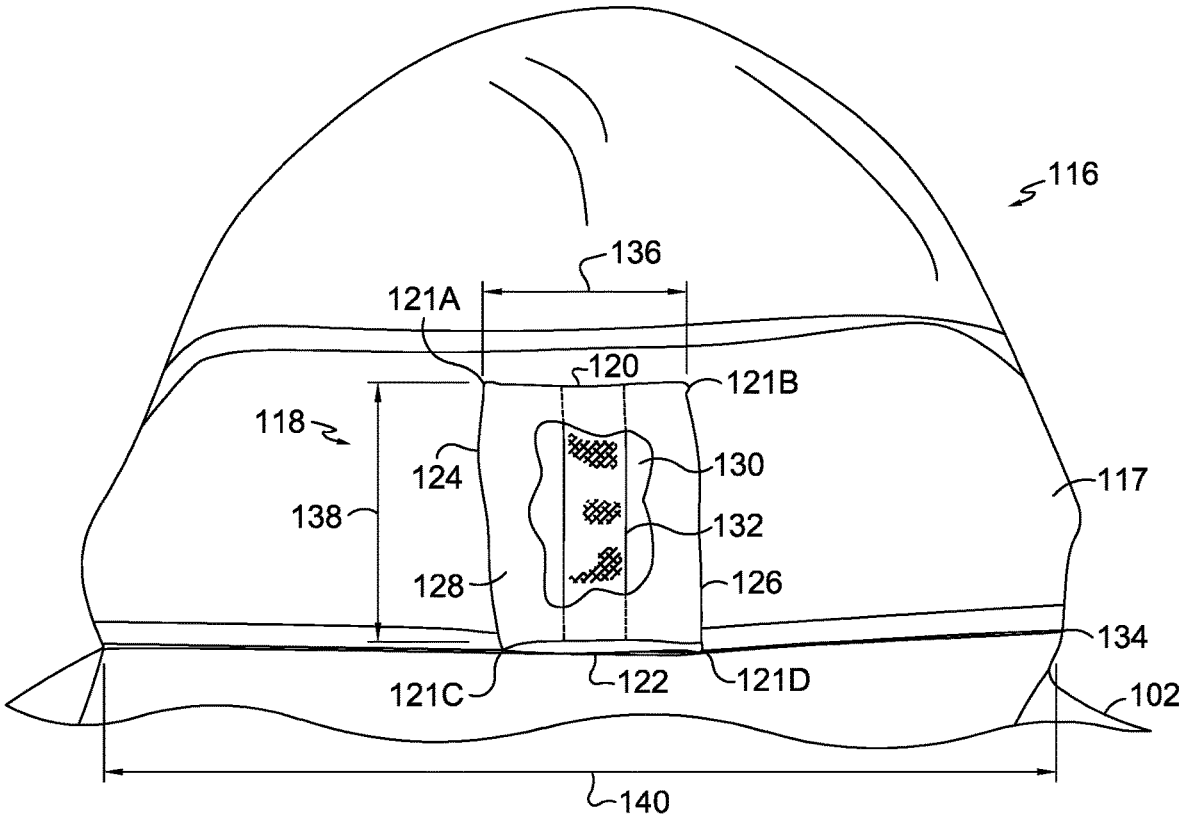
FIG. 4 illustrates an isolated front view of the hood portion of the exemplary apparel item of FIGS. 1A-1B where the hood portion comprises the pocket structure and where a portion of the pocket structure is cut away to reveal a strap positioned in the interior of the pocket structure, in accordance with an aspect herein.

Turning now to FIG. 4, FIG. 4 depicts an isolated view of the hood portion 116 to which the pocket structure 118 is affixed in accordance with aspects herein. A portion of the pocket structure 118 is cut away to illustrate the interior of the pocket structure 118. The pocket structure 118 may comprise a first end 120, a second end 122, a first longitudinal edge 124, and a second longitudinal edge 126. Additionally, the pocket structure 118 may include a first surface 128 facing away from the inner-facing surface 117 of the hood portion 116, and an opposing second surface 130 facing toward the inner-facing surface 117 of the hood portion 116 (seen in the cut-away portion). Each of the first surface 128 and the second surface 130 may have an inner-facing surface and an outer-facing surface (these terms are used with the interior of the apparel item 100 being used as a reference point). As seen in FIG. 4, as well as in FIGS. 1A and 1B, when the apparel item 100 is in a "wearable" configuration, the pocket structure 118 generally assumes a rectangular shape, such that the pocket structure 118 generally lays flat against the inner-facing surface 117 of the hood portion 116.

As depicted in FIG. 4, in exemplary aspects, the first end 120 of the pocket structure 118 is closed, while the second end 122 of the pocket structure 118 is open such that it is in communication with the interior of the pocket structure 118. However, this configuration is merely exemplary, and aspects in which the first end 120 of the pocket structure 118 is open and the second end 122 of the pocket structure 118 is closed are considered within the scope of this disclosure. Additionally, when the hood portion 116 is worn on the head of a wearer, the first end 120 of the pocket structure 118 may be located superior to the second end 122 of the pocket structure 118 when the wearer is standing.

With continued reference to FIG. 4, the pocket structure 118 is depicted as further comprising a strap 132 (viewable in the cut away area) which is affixed to an inner-facing surface of the second surface 130. In other words, the strap 132 is positioned within a void or space formed between the first surface 128 and the second surface 130. In accordance with aspects herein, the location where the strap 132 is affixed to the pocket structure 118 is variable depending on the configuration of the apparel item 100. For example, the strap 132 may be affixed to an inner-facing surface of the first surface 128, an outer-facing surface of the second surface 130, or an outer-facing surface of the first surface 128. Or, in another example, the pocket structure 118 may not contain the strap 132. In exemplary aspects, the strap 132 may be formed of a mesh material or a material with some type of surface texture to facilitate the strap being maintained in a relatively static position when secured onto a hand of a wearer.

Further, as seen in FIG. 4, a length 136 of the first end 120 and the second end 122 of the pocket structure 118 may be between 10 and 30 percent of a length 140 of an inferior margin of the hood portion 116. As used throughout this disclosure, the inferior margin of the hood portion may be defined by a seam 134 located between the hood portion 116 and the torso portion 102. However, it is envisioned that the apparel item 100 may be of a unitary construction. In other words, the seam 134 would not be present on the apparel item 100 having a unitary construction. Instead, if the apparel item 100 is of a unitary construction, the inferior margin of the hood portion 116 generally refers to a similar location in which seam 134 is shown in FIG. 4.

As such and in accordance with aspects herein, the length 136 of the first end 120 and the second end 122 of the pocket structure 118 may be between 6 and 12 centimeters. However, these lengths are merely exemplary, and pocket structures having a first end and second end outside of the 6 to 12 centimeter range are considered within the scope of this disclosure. Similarly, a length 138 of the first longitudinal edge 124 and the second longitudinal edge 126 may be between 20 and 40 percent of the length 140 of the seam 134 joining the torso portion 102 and the hood portion 116. As such and in accordance with aspects herein, the length of the first longitudinal edge 124 and the length of the second longitudinal edge 126 may be between 10 to 15 centimeters. However, as with the length 136 of the first end 120 and the second end 122, the length 138 of the first longitudinal edge 124 and the second longitudinal edge 126 is variable to allow for the apparel item 100 to fit snugly within the pocket structure 118. In other words, in one aspect, the length 138 may be up to 75 percent greater than the length 136. Or, in another aspect, the length 138 may be up to 75 percent smaller than the length 136.

In accordance with other aspects herein, each of the pocket structure 118 and/or the strap 132 may be made from an elastically resilient material, such as a four-way stretch or two-way stretch woven mesh material. As described above, use of a woven construction may help to constrain the size of the pocket structure 118 after the apparel item 100 is stowed due to the tight weave created through use of warp and weft yarns. However, it is contemplated herein that the pocket structure 118 and/or strap 132 may be formed using a knit construction. Use of a material that exhibits two-way or four-way stretch enables the pocket structure 118 to accommodate different sizes of apparel items. Moreover, use of a mesh material for the pocket structure 118 may promote breathability and movement of air as the pocket structure 118 is located adjacent to a neck of a wearer when the apparel item 100 is worn. In another aspect herein, each of the pocket structure 118 or the strap 132 may further comprise a waterproof coating for keeping the apparel item 100 dry when stowed within the pocket structure 118.

In accordance with aspects herein, the pocket structure 118 may be affixed to the inner-facing surface 117 of the hood portion 116 along the length 136 of the first end 120 and/or the second end 122, and/or the pocket structure 118 may be affixed along the length 138 of the first longitudinal edge 124 and/or second longitudinal edge 126. In other words, the pocket structure 118 may be affixed along one of the first end 120, the second end 122, the first longitudinal edge 124, or the second longitudinal edge 126, or any combination of the aforementioned edges. Or, in another aspect, the pocket structure 118 may be "tacked" down or secured at four corners 121A, 121B, 121C and 121D of the pocket structure 118. Or, in another aspect, at least a portion of the second end 122 of the pocket structure 118 may be removably or permanently coupled to the seam 134 joining the torso portion 102 and the hood portion 116. Additionally, in yet another aspect, it is contemplated that the pocket structure 118 may be integrally formed into the apparel item 100. For example, it is envisioned that the pocket structure 118 and the apparel item 100 are both formed from a knitting or weaving process that allows the pocket structure 118 to be integrally knit or woven when the apparel item 100 is being formed, rather than the pocket structure 118 being made separately and then affixed to the apparel item 100.

Further, in aspects in which the hood portion 116 is present, the pocket structure 118 may be positioned at approximately the midpoint of the inferior margin of the hood portion 116. Or, in aspects in which the hood portion 116 is not present, the pocket structure 118 may be positioned at approximately a midpoint of the neck opening 112, such that the pocket structure 118 is also positioned on an inner-facing surface 108 of the torso portion 102. In accordance with aspects herein, the "midpoint" refers to a theoretical point which would evenly divide the apparel item 100 into a first lateral side and a second lateral side. However, the pocket structure 118 may also be offset a distance of up to 10 cm away from the "midpoint", such that the pocket structure 118 is positioned closer to one lateral aspect than the other lateral aspect of the apparel item 100.

Figure 5A:
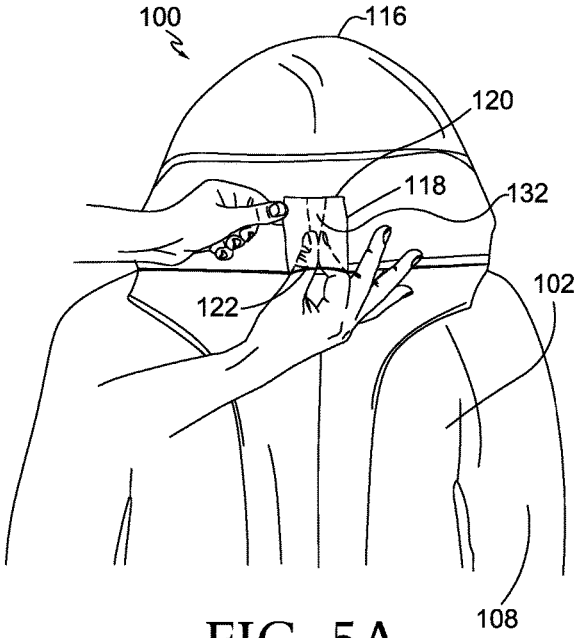
FIGS. 5A-5C illustrate a sequence of steps for converting the exemplary apparel item of FIGS. 1A and 1B to a stowed configuration, in accordance with an aspect herein.
Figure 5B:
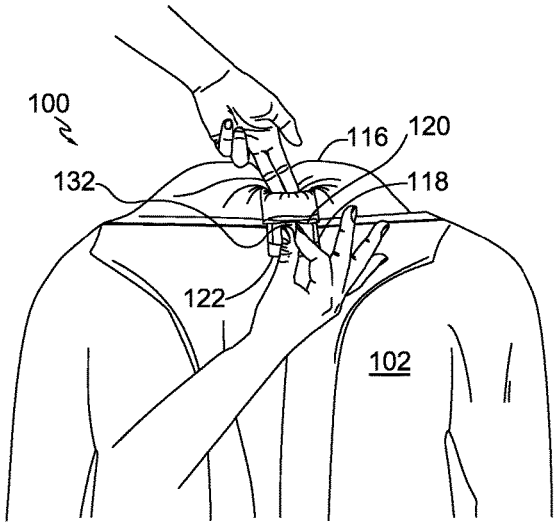

With reference now to FIG. 5A, the apparel item 100 is depicted in a "wearable" configuration, as described herein. This figure depicts a wearer beginning to convert the apparel item 100 from a "wearable" configuration to the "stowed" configuration by inserting his or her fingers inside of the pocket structure 118 to grab the strap 132. In exemplary aspects, the strap 132 is used to assist the wearer in turning the pocket structure 118 inside out, such that it will be able to receive and stow the apparel item 100. For example, as shown in FIG. 5B, the wearer's right hand is pulling the strap 132 out of the second end 122 of the pocket structure 118, while the wearer's left hand is assisting with turning the pocket structure 118 inside out. When the pocket structure 118 is being turned inside out, as depicted in FIG. 5B, the hood portion 116 is pulled into the pocket structure 118.

Figure 5C:
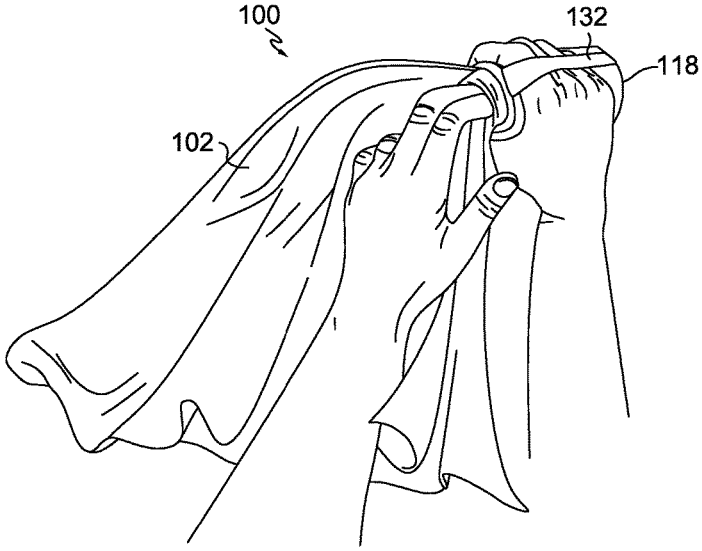
Figure 5D:
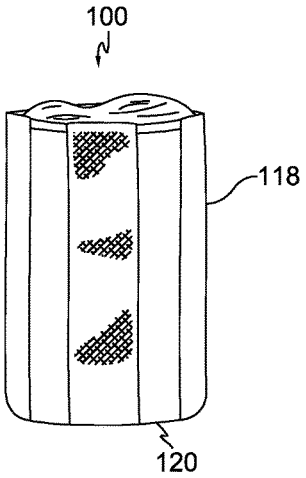
FIG. 5D illustrates the exemplary apparel item of FIGS. 1A and 1B in the stowed configuration, in accordance with an aspect herein.

With reference to FIG. 5C, the apparel item 100 is depicted as having the hood portion 116 (not shown in FIG. 5C) pulled inside of the pocket structure 118. To complete the conversion of the apparel item 100 from the "wearable" configuration to the "stowed" configuration, the torso portion 102 may also be inserted into the pocket structure 118. This is accomplished, for example, by having one hand of a wearer hold the pocket structure 118 through use of the strap 132. Next, the remaining hand of the wearer may be used to pack the torso portion 102 into the pocket structure 118. It is important to note that, due to the pocket being turned inside out, the strap 132 is now positioned on an outer-facing surface of the pocket structure 118. FIG. 5D depicts the apparel item 100 as being in the "stowed" configuration. As discussed previously, when the apparel item 100 is in the "stowed" configuration, the hood portion 116 and the torso portion 102 are contained within the pocket structure 118. Additionally, when the apparel item 100 is in the "stowed" configuration, the pocket structure 118 is generally cylindrical shaped having a diameter and a length defined as extending between the first end 120 and the second end 122. In accordance with aspects herein, the diameter of pocket structure 118 when the apparel item 100 is in the "stowed" configuration is between 7 and 10 centimeters, and the length of the pocket structure 118 when the apparel item 100 is in the "stowed" configuration is between 10 and 15 centimeters. However, the lengths and diameters described herein are exemplary, and other lengths and diameters outside of the ranges provided herein are considered to be within the scope of this disclosure.

Figure 6:
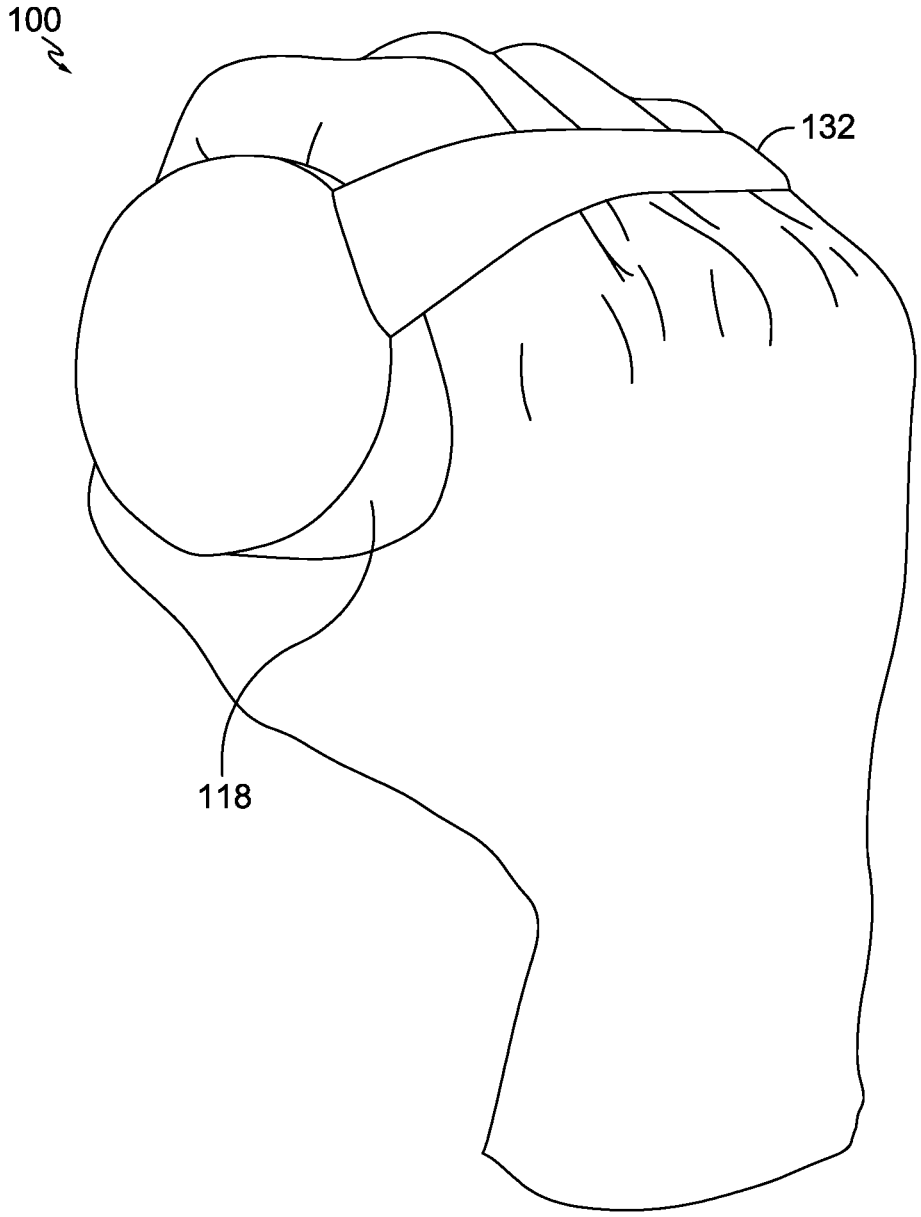
FIG. 6 illustrates an exemplary apparel item in the stowed configuration, as shown in FIG. 5D, as being held by a wearer, in accordance with an aspect herein.

Turning now to FIG. 6, the apparel item 100 as stowed within the pocket structure 118 is depicted as being held in the hand of a wearer or user in accordance with aspects herein. Although the apparel item 100 is referenced, it is contemplated herein that additional apparel items described below may also stowed such that the stowed apparel item assumes a similar configuration to that shown in FIG. 6. Moreover, the strap 132 is shown as being positioned over the wearer's fingers or palm (i.e., the strap 132 is positioned on the posterior aspect of the wearer's hand). As mentioned, when the apparel item 100 is stowed within the pocket structure 118, the resulting structure assumes a cylindrical shape. This shape is advantageous for providing an easy-to-carry configuration for the stowed apparel item 100. For example, during athletic activity, a wearer may clench his fist when exerting his or herself. In this situation, the cylindrical shape of the stowed apparel item 100 easily fits within the palm of a wearer. Additionally, if the wearer decided to "unclench" his or her fist, the strap 132 prevents the stowed apparel item 100 from being released from the grip of the wearer. Therefore, generally speaking, the features of the apparel item 100 discussed with respect to FIG. 6 are generally provided to increase mobility and convenience of carrying the apparel item 100 when not being used.

Figure 2A:
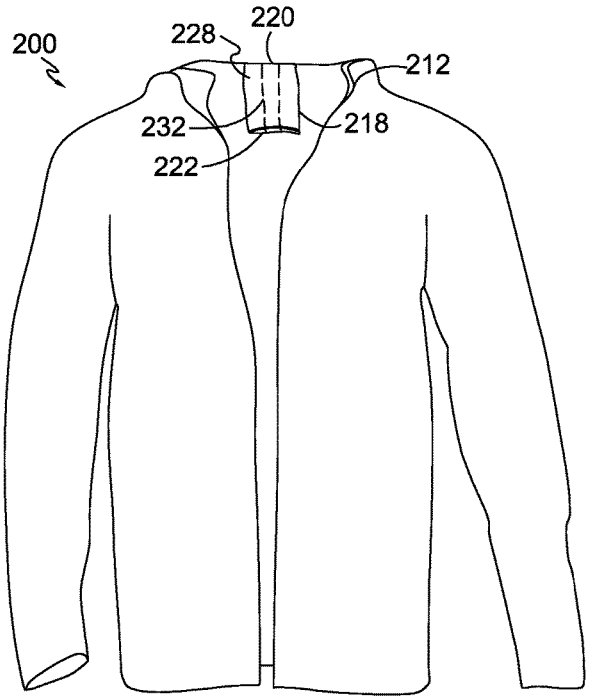
FIG. 2A illustrates a front view of an exemplary apparel item having a pocket structure positioned proximate a neck opening of the exemplary apparel item, in accordance with an aspect herein.
Figure 2B:
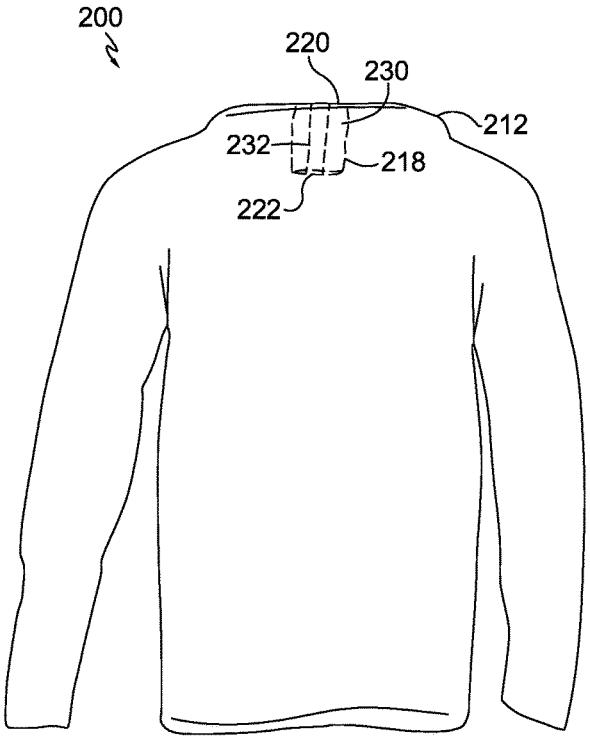
FIG. 2B illustrates a back view of the exemplary apparel item of FIG. 2A, in accordance with an aspect herein.

Turning now to FIGS. 2A and 2B, an exemplary apparel item 200 is depicted in accordance with aspects herein. Unlike the apparel item 100 shown in FIGS. 1A and 1B, the apparel item 200 is shown as not having a hood portion. With respect to this aspect, a pocket structure 218 may be positioned proximate to a neck opening 212 of the exemplary apparel item 200, in accordance with an aspect herein. More specifically, a first end 220 of the pocket structure 218 is positioned proximate the neck opening 212 of the apparel item 200, while a second end 222 of the pocket structure is positioned inferior to the first end 220. As used throughout this disclosure, the term "proximate" means within 0.01 cm to 10 cm of a designated reference point. In one aspect, the first end 220 of the pocket structure 218 may be closed, while the second end 222 of the pocket structure 218 may be open. However, aspects in which the first end 220 of the pocket structure 218 is open and the second end 222 of the pocket structure 218 is closed are also considered to be within the scope of this disclosure.

In order to convert the apparel item 200 to the "stowed" configuration, the steps shown in FIGS. 5B and 5C may also be applied to the apparel item 200. However, as the apparel item 200 does not have a hood portion, the step of inserting a hood portion into the pocket structure 218 may be skipped. In other words, the step shown in FIG. 5A does not need to be applied to the apparel item 200, as the apparel item 200 does not have a hood portion. Similar to the apparel item 100, when the apparel item 200 is in the "wearable" configuration, the pocket structure 218 may comprise a strap 232 positioned within a void formed between a first surface 228 and a second surface 230. However, when the apparel item 200 is in the "stowed" configuration, the strap 232 is positioned or located on an external-facing surface of the pocket structure 218, similar to what is shown in FIGS. 5D and 6.

Figure 3A:
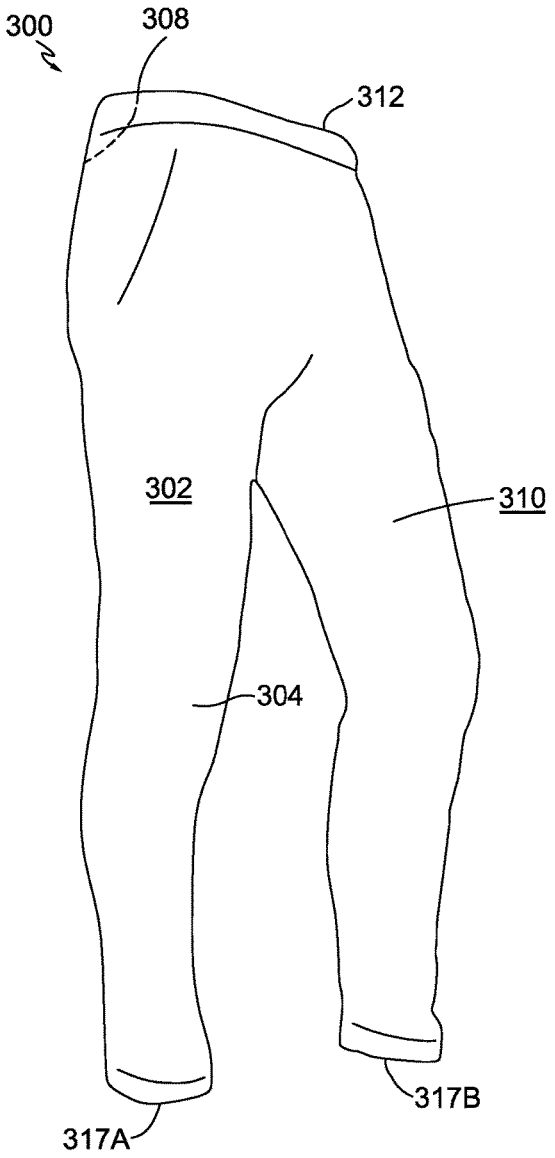
FIGS. 3A-3B illustrate front and back perspective views respectively of an exemplary apparel item having a pocket structure, in accordance with an aspect herein.
Figure 3B:
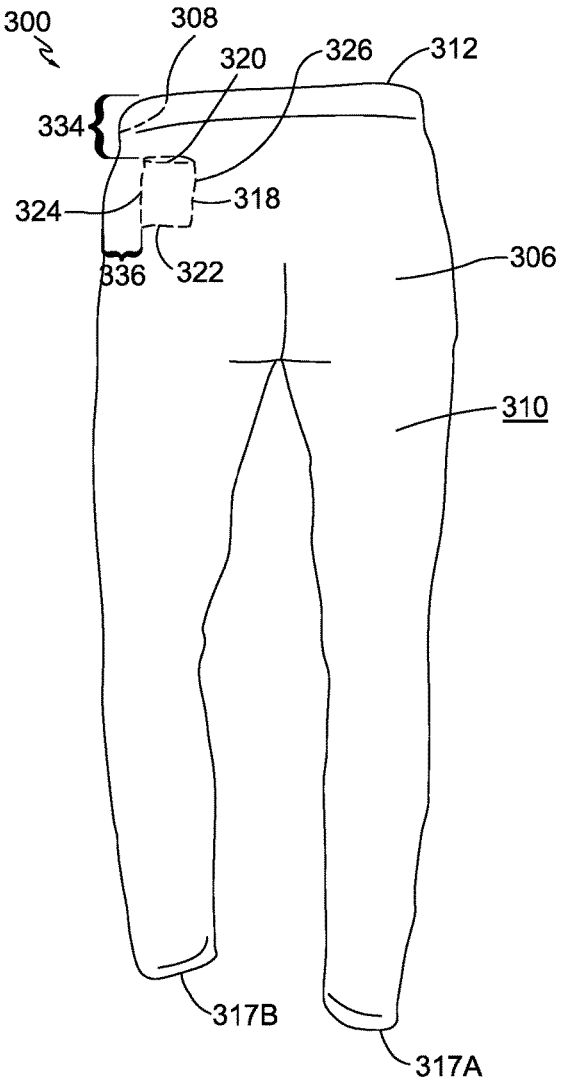

Turning now to FIGS. 3A and 3B, front and back perspective views respectively of an apparel item 300 having a pocket structure 318 are illustrated in accordance with aspects herein. As seen in FIGS. 3A and 3B, the apparel item 300 is depicted as a lower-body apparel item, such as a pair of pants. However, other types of lower-body garments, such as shorts, athletic shorts, cargo pants, sweatpants and the like, are considered to be within the scope of this disclosure.

The apparel item 300 has a lower-body portion 302, a front aspect 304, a back aspect 306, an inner-facing surface 308 and an outer-facing surface 310. Additionally, the apparel item 300 has a torso opening 312 and a first leg opening 317A and a second leg opening 317B for receiving the legs of a wearer.

Additionally, in accordance with aspects herein, the apparel item 300 may comprise a pocket structure 318 which is able to receive and store the apparel item 300 when in a "stowed" configuration. The pocket structure 318 is shown in dashed lines to indicate that it is positioned on the inner-facing surface of the apparel item 300. In general, the pocket structure 318 may be positioned at any location on the apparel item 300. However, in one aspect, the pocket structure 318 may be placed at a portion of the apparel item 300 that aligns with a back portion of a wearer's high hip, similar to what is shown in FIG. 3B. This configuration is advantageous as it reduces chafing that would normally occur during movement of the legs or torso of a wearer.

The pocket structure 318 may include a first end 320, a second end 322, a first longitudinal edge 324, and a second longitudinal edge 326. In accordance with aspects herein, the first end 320 of the pocket structure 318 may be positioned a first distance away 334 from the torso opening 312, and the first longitudinal edge 324 of the pocket structure 318 may be positioned a second distance 336 away from a lateral aspect 314 of the apparel item 300. As used throughout this disclosure, the term "lateral aspect" may mean a position furthest away from a midline of the apparel item 300. The first distance 334 may be between 0 and 12 centimeters from the torso opening 312, while the second distance 336 may be between 0 and 10 centimeters from the lateral aspect 314 of the apparel item 300. In exemplary aspects, the first end 320 of the pocket structure 318 may comprise the open end of the pocket structure 318, and the second end 322 of the pocket structure 318 may comprise a closed end of the pocket structure 318. As shown, in exemplary aspects, the first end 320 may be superior to the second end 322 of the pocket structure 318. In yet another aspect, the pocket structure 318 may include a strap, similar to the strap shown in FIG. 4. However, the inclusion of a strap is optional, and pocket structures without a strap are considered to be within the scope of this disclosure.

In accordance with aspects herein, the apparel item 300 may converted to the "stowed" configuration by steps similar to what is shown in FIGS. 5A-5C. For example, the pocket structure 318 may be inverted, and then each of the leg portions may be inserted into the inverted pocket structure. This may be accomplished by overlapping each of the leg portions and then "rolling" them into a compact cylindrical shaped structure, which may then be easily inserted into the pocket structure 318, similar to the act of rolling and packing a sleeping bag into a carrying case. Or, in the alternative, each of the leg portions may be "stuffed" into the inverted pocket structure.

Examples of the present invention have been described with the intent to be illustrative rather than restrictive. Alternative examples will become apparent to those skilled in the art that do not depart from its scope. A skilled artisan may develop alternative means of implementing the aforementioned improvements without departing from the scope of the present invention.

It will be understood that certain features and subcombinations are of utility and may be employed without reference to other features and subcombinations and are contemplated within the scope of the claims.

What is claimed is:

1. An apparel item for an upper torso of a wearer comprising:

a torso portion adapted to cover a torso area of a wearer when the apparel item is in an as-worn configuration, the torso portion having at least a front aspect, a back aspect, an inner-facing surface, and an outer-facing surface, the torso portion defining at least a neck opening and a waist opening;

a hood portion affixed to the neck opening of the torso portion, the hood portion having an inner-facing surface and an outer-facing surface; and a pocket structure having an open end and a closed end, a first longitudinal edge extending between the open end and the closed end and a second longitudinal edge extending between the open end and the closed end, wherein:

both the open end and the closed end of the pocket structure are affixed to the inner-facing surface of the hood portion proximate the neck opening such that the pocket structure is positioned adjacent to at least a part of the hood portion, the open end of the pocket structure is positioned inferior to the closed end of the pocket structure, the pocket structure includes a single strap that extends between the open end and the closed end of the pocket structure and is positioned midway between the first longitudinal edge and the second longitudinal edge of the pocket structure, and the pocket structure is sized to be able to receive and store the apparel item when the apparel item is in a stowed configuration.

2. The apparel item of claim 1, wherein the pocket structure further comprises a first surface facing away from the inner-facing surface of the hood portion and an opposing second surface facing toward the inner-facing surface of the hood portion.

3. The apparel item of claim 2, wherein a length of the closed end and the open end of the pocket structure is between 10 and 30 percent of a length of an inferior margin of the hood portion.

4. The apparel item of claim 3, wherein a respective length of the first longitudinal edge and the second longitudinal edge is between 20 and 40 percent of the length of the inferior margin of the hood portion.

5. The apparel item of claim 4, wherein at least a portion of the open end of the pocket structure is permanently affixed to the inferior margin of the hood portion.

6. The apparel item of claim 4, wherein the open end of the pocket structure is affixed to the inner-facing surface of the hood portion at approximately a midpoint of the inferior margin of the hood portion.

7. The apparel item of claim 1, wherein the apparel item is formed from a material weighing between 10 to 150 grams per square meter.

8. The apparel item of claim 1, wherein the pocket structure is formed from a woven or a knit material.

9. The apparel item of claim 1, wherein the pocket structure is formed from an elastically resilient material.

10. An apparel item comprising:

a torso portion adapted to cover a torso area of a wearer when the apparel item is in an as-worn configuration, the torso portion having at least a front aspect, a back aspect, an inner-facing surface, and an outer-facing surface, the torso portion defining at least a neck opening and a waist opening;

a hood portion affixed to the neck opening of the torso portion, the hood portion having an inner-facing surface and an outer-facing surface; and a pocket structure having a first end and a second end, wherein the first end and the second end of the pocket structure are affixed in part to the inner-facing surface of the hood portion proximate the neck opening;

wherein:

the pocket structure is sized to be able to receive and store the apparel item when the apparel item is in a stowed configuration, the pocket structure further including a first longitudinal edge, a second longitudinal edge, a first surface facing away from the inner-facing surface of the hood portion and an opposing second surface facing toward the inner-facing surface of the hood portion, the first surface and the second surface defining a void between the first surface and the second surface, the pocket structure includes a single strap that extends between the first end and the second end of the pocket structure and is positioned midway between the first longitudinal edge and the second longitudinal edge of the pocket structure, and the first end of the pocket structure is closed and the second end of the pocket structure is open, and wherein the second end is positioned inferior to the first end of the pocket structure.

11. The apparel item of claim 10, wherein when the apparel item is in the stowed configuration, the pocket structure is generally cylindrical shaped having a diameter and a length defined as extending between the first end and the second end.

12. The apparel item of claim 11, wherein the diameter of the generally cylindrical shaped pocket structure is between 7 and 10 centimeters.

13. The apparel item of claim 11, wherein the length of the generally cylindrical shaped pocket structure is between 10 and 15 centimeters.

14. The apparel item of claim 10, wherein the single strap is affixed to an inner-facing surface of the first surface of the pocket structure.

15. The apparel item of claim 10, wherein the single strap is affixed to an inner-facing surface of the second surface of the pocket structure.

16. The apparel item of claim 10, wherein the single strap is affixed to an outer-facing surface of the first surface of the pocket structure.

17. The apparel item of claim 10, wherein the single strap is affixed to an outer-facing surface of the second surface of the pocket structure.

* * * * *